United States Patent [19]

Burke

[11] 4,300,596

[45] Nov. 17, 1981

[54] ADJUSTABLE PARALLEL FLUIDIC RESISTOR BANK

[75] Inventor: John F. Burke, Huntsville, Ala.

[73] Assignee: The United States of America as represented by the Secretary of the Army, Washington, D.C.

[21] Appl. No.: 70,772

[22] Filed: Aug. 30, 1979

[51] Int. Cl.[3] ..... F15C 1/14; F15D 1/00

[52] U.S. Cl. ..... 137/836; 137/599; 138/46

[58] Field of Search ..... 137/599, 833, 825, 835, 137/836, 837; 138/40, 46, 44, 45; 251/4

[56] References Cited

U.S. PATENT DOCUMENTS

| | | | |
|---|---|---|---|
| 2,532,452 | 12/1950 | Hoesel | 138/45 |
| 3,170,476 | 2/1965 | Reilly | 137/836 |
| 3,371,675 | 3/1968 | Hatch, Jr. | 137/835 |
| 3,402,727 | 9/1968 | Boothe | 137/835 |
| 3,465,790 | 9/1969 | Everhard | 138/45 |
| 3,534,755 | 10/1970 | Urbanosky | 137/833 X |
| 3,556,157 | 1/1971 | Eckerlin | 138/46 |
| 3,580,265 | 5/1971 | Horacek | 137/836 |
| 3,986,527 | 10/1976 | Mon | 137/837 X |

*Primary Examiner*—William R. Cline

*Attorney, Agent, or Firm*—Nathan Edelberg; Robert P. Gibson; Saul Elbaum

[57] ABSTRACT

A fluidic resistor module, including resistor channels connected in parallel between two common ports, is permanently adjustable by deforming the cross sections of the individual channels by externally applied forces. The channels are formed on the interior surface of an exterior plate of a bonded plate module, and the indicia indicating the locations of the channels are formed on the exterior surface of the plate. A pair of adjustable resistor modules are used to null opposed fluidic bias means in a laminar fluidic device.

5 Claims, 7 Drawing Figures

ADJUSTABLE PARALLEL FLUIDIC RESISTOR BANK

RIGHTS OF THE GOVERNMENT

The invention described herein may be manufactured, used, and licensed by or for the U.S. Government for governmental purposes without the payment to me of any royalty thereon.

BACKGROUND OF THE INVENTION

The invention relates generally to fluidic components and, more specifically, to a means of adjusting internal pressures and flow in bonded fluidic modules to overcome unacceptable functional characteristics due to manufacturing variations.

In the use of certain precise fluidic devices, it is important that they be designed so that the devices can be functionally adjusted to overcome the variations in the manufactured fluidic parts. An example of the need for precise module adjustment is the laminar jet angular rate sensor. This sensor is a highly sensitive fluidic component that requires high-precision fabrication methods. However, such fabrication methods are generally so costly that the use of analogous electrical and mechanical devices is given preference. To solve the cost problem, bias-control nozzles have been added at the offset of the laminar jet nozzle. The bias-control flow can adjust the position of the laminar jet and compensate for the nonsymmetrical geometry of the sensor due to manufacturing variations.

However, the use of the bias-control nozzles has produced a problem of how to precisely adjust the bias controls so that they maintain their adjustment regardless of the temperature changes or vibration and acceleration forces that the device might encounter in the field. The prior art sensor utilized a needle valve or a sensor means to effect the bias-control adjustment; however, it has been found that when the device is being used in the field and is subject to the above-mentioned temperature, vibration and acceleration forces, the precision of pre-set adjustments may be lost.

Thus, there exists a need for a means to precisely adjust fluidic devices, such as a jet angular rate sensor, with such adjustment means not being affected by external forces encountered while the device is in use.

OBJECTS OF THE INVENTION

It is an object of the invention to provide a means of precisely controlling fluid flow in channels of a bonded fluidic module.

It is another object of the invention to provide an inexpensive module which can be easily placed within the appropriate channels of a fluidic device and which can be finely adjusted to overcome the manufacturing variations in the fluidic device.

It is still another object of the invention to provide a module which can be easily adjusted and which will retain the adjustment during use of the fluidic device.

SUMMARY OF THE INVENTION

The above-outlined objectives, as well as other objects and features of the present invention, are accomplished by an adjustable parallel fluidic resistor module that comprises a plurality of channels connected in parallel fluidically between the input and output of the resistor module. Each channel may be permanently partially or fully closed by an externally applied deformation force to thereby produce a fine incremental change in resistance of the module. A pair of resistor modules may be used, for example, in a laminar jet angular rate sensor with a resistor module connected in series with each of the bias-control nozzles. To adjust the flow to one of the bias-control nozzles to null the sensor, one or more of the parallel channels in the resistor module can be partially or completely closed. The bias-control nozzles and their respective resistor module may be connected to the input or respective output paths. The resistor module or the fluidic device in which the resistor module is built includes a plurality of plates bonded together. The resistor channels are formed on the interior surface of one of the exterior plates, and the exterior surface of the exterior plate includes indicia for indicating the position or location of the resistor channels. Preferably, the indicia are image protrusions on the exterior surface, resulting from the formation of the channels on the interior surface. Alternatively, the indicia may be cavities receiving a guide of a deformation force-producing device.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
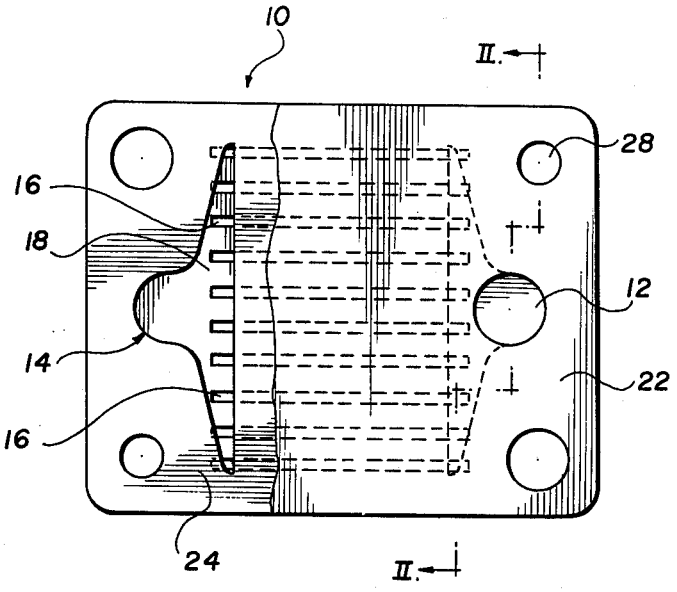
FIG. 1 is a plane view of a parallel fluidic resistor module with portions cut away incorporating the principles of the present invention.
Figure 2:
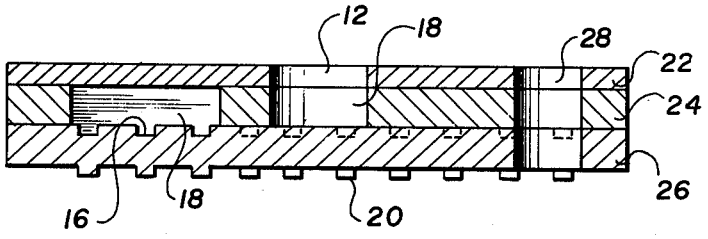
FIG. 2 is a cross-sectional view of the parallel fluidic resistor module taken along lines II—II of FIG. 1.

A parallel fluidic resistor module 10 is illustrated in FIGS. 1 and 2 as including two ports, 12 and 14, with a plurality of channels 16 connected fluidically in parallel therebetween. A passage 18 is connected to each of the respective ports 12 and 14 and each of the resistor channels 16 to produce the fluidic parallel connection. Indicia 20 are provided on the exterior of the module 10 to indicate the location of the individual channels 16. The indicia 20, as illustrated in FIG. 2, are protrusions on the exterior of module 10 which are images of the individual resistor channels 16 on the interior of the module 10. As will be explained more fully in the discussion of FIGS. 3 and 4, the indicia facilitate locating the individual resistor channels 16, such that they may be partially or fully restricted so as to adjust the overall resistance of the fluidic resistor module 10.

The parallel fluidic resistor module 10, as illustrated in FIGS. 1 and 2, is formed from a plurality of plates 22, 24 and 26 bonded together by, for example, a semisolidstate diffusion bonding process. The ports 12 and 14 are formed in a first exterior plate 22, the port-to-resistor channel regions 18 are formed in middle plate 24, and the resistor channels 16 and indicia 20 are formed on exterior plate 26. A plurality of openings 28 are formed in all three plates for mounting the module 10 to a fixture or device with which it is to be used. The resistor channels 16 and indicia 20 may be simultaneously formed in plate 26 by a semipiercing, fineblanking process or by coining. Thus, by application of sufficient force on the interior surface of plate 26, the channels and the image-protrusion indicia are simultaneously formed.

Although the indicia 20 are illustrated in FIG. 2 as being protrusions, a decal or other type of substantially planar indicia may be provided on the exterior surface of plate 26, representing an image of the channels 16. These are but two examples of indicia which are capable of facilitating the location of the interior resistor channels 16.

To adjust the overall resistance of the resistor module 10, one or more of the resistor channels 16 are partially or fully closed by application of an external deformation force. For parallel resistors, the inverse value of the resistance of the resistor module 10 is the sum of the inverse of the resistive values of the individual resistor channels 16. If the resistive values of all the resistor channels 16 are equal, the resistance of the module 10 becomes the resistance of the individual channels 16 divided by the total number of channels 16 unobstructed. Thus, for the resistor module (FIG. 1), the total resistance of the module 10, is equal to the resistance of the individual channels 16 divided by ten. By applying sufficient external force to obscure or totally block one of the channels 16, the overall resistance of the resistor module 10 is increased to 1/9th of the resistance of a channel 16. Thus, it can be seen, by providing a plurality of parallel resistor channels, the overall resistance of the module may be finely and permanently adjusted by using a rather crude adjustment tool, for example a punch to close one or more of the channels 16. By providing the ability for such fine adjustment, errors in the precision of manufacturing can be eliminated or permanently adjusted for, without the problems of the prior art devices.

Figure 3:
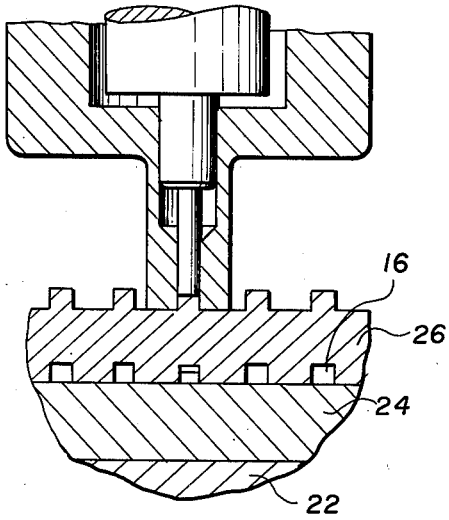
FIG. 3 is a partial cross-sectional view illustrating the method of adjusting the parallel fluidic resistor module having a first type of indicia.
Figure 4:
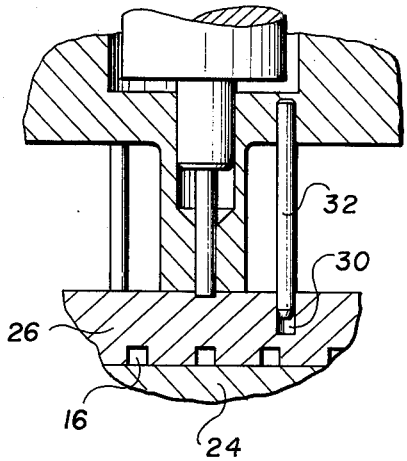
FIG. 4 is a partial cross-sectional view illustrating another method of adjusting the parallel fluidic resistor module having a second type of indicia.

Although the present example has chosen the resistances of the resistor channels 16 to be equal, they may be formed of unequal value by varying the width and/or depth of the channel. Similarly, the example was used wherein an individual channel was totally blocked. Instead, the channel may be partially blocked to produce even a finer adjustment of the resistance device. This would require the use of a ram precisely controlled by screw or worm gear drive, as illustrated in FIGS. 3 and 4. Using this procedure, the resistor module 10 is connected to a test bench having fluid and fluid controls connected to the ports 12 and 14 to monitor the overall resistance of the module 10. The precisely controlled ram is positioned on indicia protusion 20 above a resistor channel 16 and applies a slowly increasing deformation force on the exterior surface of plate 26 to controllably obstruct or deform the interior of a selected channel 16. The resistance is monitored until the precise, desired, overall resistance for the module is obtained, whereupon the deformation force is terminated. The desired resistance for module 10 may be obtained by partially or completely blocking one or more resistor channels 16.

FIG. 4 illustrates a second embodiment of the indicia on the exterior surface of exterior plate 26 to include a cavity 30 to receive a guide pin 32 of the deformation force-applying ram. Although only a single cavity 30 is illustrated in FIG. 4, a plurality of such cavities is included to precisely locate the ram above the individual resistor channels 16. This is but another example of a type of indicia which may be used to facilitate locating the channels 16 for the application of external deformation forces.

Figure 5:
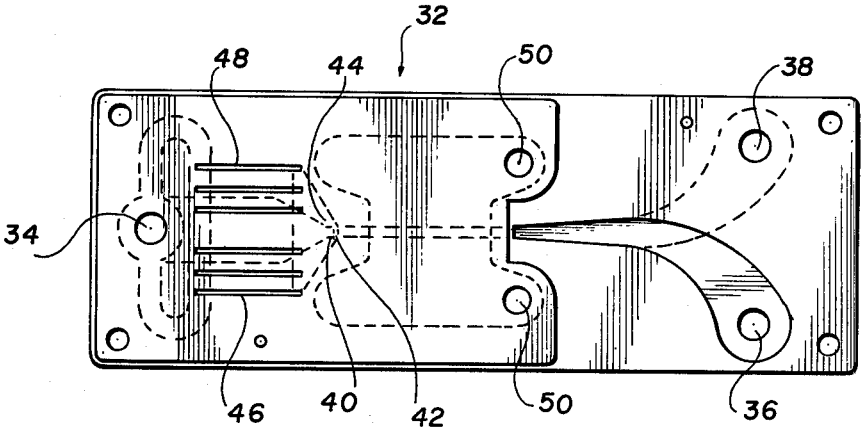
FIG. 5 is a plane view of a fluidic device incorporating a pair of parallel fluidic resistor modules.
Figure 6:
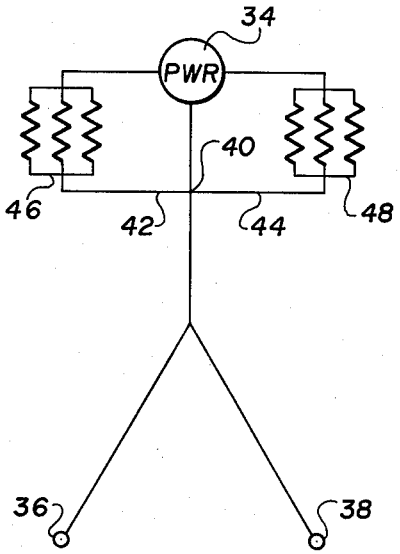
FIG. 6 is a fluidic schematic of the fluidic device illustrated in FIG. 5.
Figure 7:
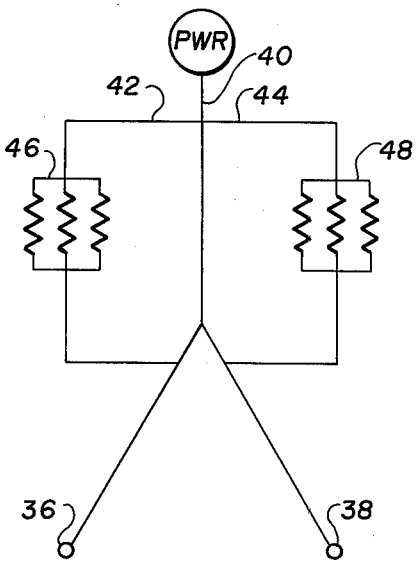
FIG. 7 is an alternate fluidic schematic for a fluidic device of the type illustrated in FIG. 5.

An example of a fluidic device in which an adjustable parallel fluidic resistor module may be used or built is illustrated in FIG. 5 as a laminar jet angular rate sensor 32. The sensor 32 includes an input port 34 and a pair of differential output ports 36 and 38. Connected to the input port 34 is a laminar jet nozzle 40 having a pair of opposed bias-control nozzles 42 and 44 on each side thereof. Connected in series with respective bias-control nozzles 42 and 44 are adjustable parallel fluidic resistor elements 46 and 48. A pair of vents 50 are shown on each side of the laminar jet nozzle 40. As illustrated in the schematic FIG. 6, the bias-control nozzles 42 and 44 and their respective parallel fluidic resistor elements 46 and 48 are connected to the input port 34. Alternatively, as illustrated in FIG. 7, the bias-control nozzles 42 and 44 and their respective serially connected parallel fluidic resistor elements 46 and 48 may be connected to respective output ports 36 and 38. The configuration illustrated in FIG. 7 provides a negative feedback.

Because of errors in manufacturing tolerances, the bias-control nozzles 42 and 44 do not necessarily provide a null indication in combination with the laminar jet nozzle 40. It is critical to the operation of the laminar jet angular rate sensor that a null of the fluid emitted from the laminar jet nozzle 40 is a null producing a flow equally distributed between outputs 36 and 38. If, for example, the resistance of a bias-control path including resistor element 46 and bias-control nozzle 42 is less than that of bias-control nozzle 44 and resistor element 48, the resistor element 46 may be adjusted by partially or fully obstructing or blocking one or more channels of the resistor element 46. As with the resistor module 10, the laminar jet angular rate sensor 35 is connected to a test fixture and the outputs 36 and 38 are monitored while the adjustment of the resistor element 46 is conducted until a null results. If during the adjustment of resistor element 46, the resistance of element 46 and bias-control nozzle 42 increases beyond the combination of resistor element 48 and bias-control nozzle 44, the adjustment of resistor element 46 is terminated and resistor element 48 is adjusted until the resistance of the paths are equal so as to null the angular rate sensor.

From the preceding description of the preferred embodiments, it is evident that the objects of the invention are obtained in that a fluidic resistor module is provided which is capable of being permanently are precisely adjusted. Although the invention has been described and illustrated in detail, it is to be clearly understood that the same is by way of illustration an example only and is not to be taken by way of limitation. The resistor module has been described as a module or as part of a laminar jet angular rate sensor as an example of one of many types of fluidic devices in which adjustable resistor elements can be used.

I wish it to be understood that I do not desire to be limited to the exact details of the construction shown and described, for obvious modifications can be made by a person skilled in the art.

What is claimed:

1. A permanently adjustable fluidic resistor module comprising:

a body member;

input means for inputting a fluid flow to said body member;

output means for outputting a fluid flow from said body member;

a plurality of fluidic resistor channel means connected in parallel between said input means and said output means, said channel means situated side by side within said body member, each of said plurality of channel means separated from an adjacent channel means by a first portion of said body member; and a second portion of said body member adjacent to said channel means comprising a material capable of plastic deformation in response to a stress applied thereto, said body member comprising:

a first exterior plate;

a middle plate joined to said first exterior plate;

a second exterior plate, formed of a material capable of plastic deformation, having an inner surface and an outer surface, said inner surface having grooves thereon;

wherein said resistor channel means are formed by joining said inner surface of said second exterior plate to said middle plate; and wherein said first exterior plate, said middle plate and said second exterior plate each have channel means for cooperatively providing a continuous path from said inlet means, to said resistor channel means and then to said outlet means; whereby the resistance of said resistor module may be permanently adjusted by deforming said material and thus the cross section of selected ones of said channel means.

2. In a fluidic device which comprises inlet means, a nozzle means for directing a stream of fluid toward outlet means, said outlet means comprising dual outlet paths, and dual biasing means disposed on opposite sides of said fluid stream for regulating the position of said fluid stream with respect to said dual outlet paths in response to a pressure differential between said dual biasing means, the improvement comprising means for permanently balancing said fluidic device, said balancing means comprising a permanently adjustable resistor as in claim 1 associated with each of said dual biasing means.

3. A permanently adjustable fluidic resistor module as recited in claim 1, further comprising means on said outer surface of said second exterior plate for locating the exact position of each of said channel means to facilitate an application of said stress.

4. A permanently adjustable fluidic resistor module as recited in claim 3, wherein said means for locating the exact position of each of said channel means comprises indicia imprinted, engraved or protruding from said outer surface of said second exterior plate.

5. A permanently adjustable fluidic resistor module as recited in claim 4, wherein each of said channel means is of a different cross sectional dimension.

* * * * *